United States Patent [19]

Dassler

[11] 4,399,621

[45] Aug. 23, 1983

[54] ATHLETIC SHOE, ESPECIALLY TENNIS SHOE

[75] Inventor: Armin A. Dassler, Herzogenaurach, Fed. Rep. of Germany

[73] Assignee: PUMA-Sportschuhfabriken Rudolf Dassler KG, Herzogenaurach, Fed. Rep. of Germany

[21] Appl. No.: 306,864

[22] Filed: Sep. 29, 1981

Related U.S. Application Data

[63] Continuation-in-part of Ser. No. 296,785, Aug. 27, 1981.

[30] Foreign Application Priority Data

Aug. 27, 1980 [DE] Fed. Rep. of Germany ... 8022784[U]

[51] Int. Cl.[3] ..... A43B 13/04

[52] U.S. Cl. ..... 36/32 R; 36/114; 36/129

[58] Field of Search ..... 36/128, 129, 114, 126, 36/32 R, 28, 29, 30 R, 59 R, 59 C

[56] References Cited

U.S. PATENT DOCUMENTS 3,971,145 7/1976 Stegerwald ..... 36/32 R
4,316,335 2/1982 Giese et al. ..... 36/129
4,319,412 3/1982 Muller ..... 36/59 C

FOREIGN PATENT DOCUMENTS 310459 4/1917 Fed. Rep. of Germany ..... 36/59 R
1034238 7/1953 France ..... 36/32 R

*Primary Examiner*—Werner H. Schroeder
*Assistant Examiner*—Steven N. Meyers
*Attorney, Agent, or Firm*—Antonelli, Terry & Wands

[57] ABSTRACT

Athletic shoes, particularly tennis shoes, are known which are provided with an ankle support in the zone of the arch of the foot (plantar arch) between the ball and the heel. In many such athletic shoes with ankle joint supports, the tread sole is fashioned with a corresponding constriction in the ankle region so that the inner ankle support is not shored up in the direction of the tread surface. To prevent such athletic shoes from buckling or bending flexurally in the ankle zone under high stresses, or even "break through", several discrete supporting profiles of varying heights are provided at the tread sole, the enveloping line of which on the free ends of these supporting profiles on the tread side lies at least approximately in the plane of the adjoining tread sole parts.

18 Claims, 5 Drawing Figures

ATHLETIC SHOE, ESPECIALLY TENNIS SHOE

This application is a continuation-in-part application of my U.S. patent application Ser. No. 296,785, filed on Aug. 27, 1981.

BACKGROUND AND SUMMARY OF THE INVENTION

The invention relates to an athletic shoe, especially a tennis shoe, with an insole forming an ankle joint support in the zone of the arch of the foot or with an ankle joint support applied to the insole and with a tread sole provided with a substantially corresponding constriction in the region of the arch of the foot.

Athletic shoes with ankle supports of the above-defined type have been known for a long time and in many versions.

A disadvantage in the conventional athletic shoes with ankle supports resides in that the corresponding constriction in the ankle zone of the tread sole of the athletic shoe is not shored up so that the ankle support, unless it is of sufficiently rigid construction (which is often impossible for reasons of weight and elasticity) buckles flexurally or is even "broken through". However, this reduces the efficiency of the ankle support noticeably, or even eliminates same altogether.

Other athletic shoes with ankle support and continuous tread sole, preferably a wedge sole, without a corresponding constriction in the ankle region of the tread sole, are disadvantageous insofar as the weight of such athletic shoes is frequently unduly increased. In such designs, a well-fitting form is thus obtained at the cost of a considerable reduction in efficiency of the person wearing such an athletic shoe.

Thus, the invention has an object of fashioning an athletic shoe, especially a tennis shoe, of the type discussed hereinabove in such a way that the effect of the ankle support is fully preserved even in case of extreme stresses on the tread sole, without unduly raising the weight of such an athletic shoe.

This object has been attained according to a preferred embodiment of the invention by providing in the zone of the constriction of the tread sole several discrete supporting profiles of various heights, the enveloping line of which on the free ends of these supporting profiles on the tread side lies at least approximately in the plane of the adjoining tread sole parts.

The discrete supporting profiles thus form, in the zone of the sole constriction, an arbitrarily designed grid, which adequately supports the ankle support so that flexural buckling or even "breaking through" of the ankle support is no longer possible.

The dimensions of the supporting profiles are preferably chosen so that there is no noticeable weight gain.

These and other objects, features, and advantages of the present invention will become more apparent from the following description when taken in connection with the accompanying drawings which show, for purposes of illustration only, several embodiments in accordance with the present invention.

DETAILED DESCRIPTION OF THE PREFERRED EMBODIMENTS

Figure 1:
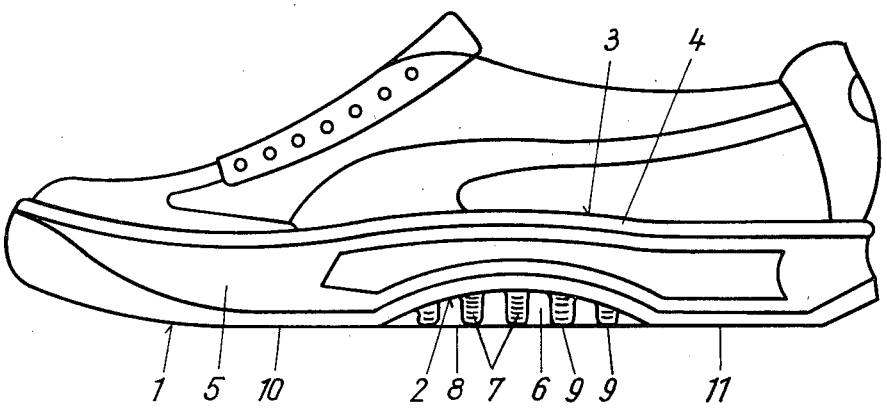
FIG. 1 shows a lateral view of an athletic shoe according to the invention with supporting profiles in the zone of the plantar arch.
Figure 2:
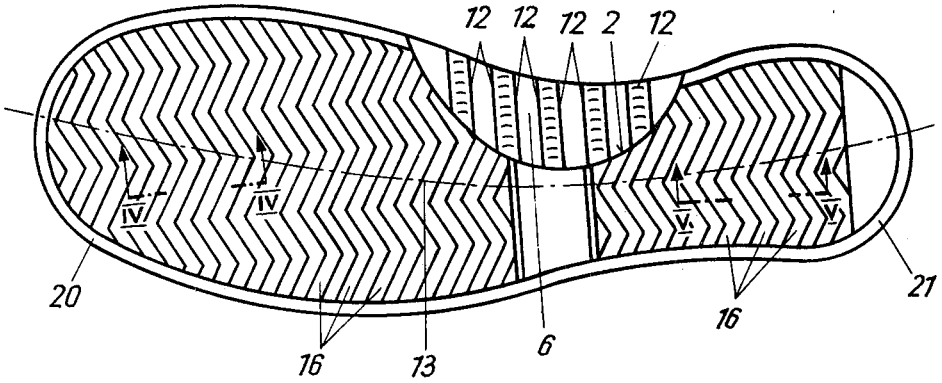
FIG. 2 shows a bottom view of the athletic shoe illustrated in FIG. 1.

FIGS. 1 and 2 illustrate a lateral view and a bottom view, respectively, of an athletic shoe, especially a tennis shoe 1, exhibiting in the zone of the plantar arch 2 an ankle support 3 formed preferably from the insole 4 by a corresponding design of the tread sole 5. However, it is basically also possible to apply the ankle support 3 in the form of a separate insert to the insole 4.

The tread sole 5 is provided in the zone of the plantar arch 2 with a constriction 6 essentially corresponding to the ankle support 3. To avoid flexural buckling or even "breaking through" of the ankle support 3, several discrete supporting profiles 7 of various heights are provided in the region of the constriction 6 of the tread sole 5, the enveloping line 8 of which on the free ends 9 of the supporting profiles 7 on the tread side lies at least approximately in the plane of the adjoining tread sole parts, namely the front sole 10 and the heel 11. The arrangement is preferably such that the enveloping line 8 lies practically in the connecting plane between the tread surfaces of the sole parts 10 and 11. If a certain, minor springing is to be permitted in the region of the plantar arch 2, then it is basically possible to fashion the supporting profiles 7 so that the enveloping line 8 thereof lies on a slightly convex curve, i.e., so that the ends 9 of the central supporting profiles 7 on the tread side are somewhat set back with respect to the tread surfaces of the sole parts 10 and 11.

Preferably, the supporting profiles 7, as can be seen especially from FIG. 2, are fashioned as ribs 12, which extend at least approximately vertically to the longitudinal axis 13 of the sole.

Figure 3:
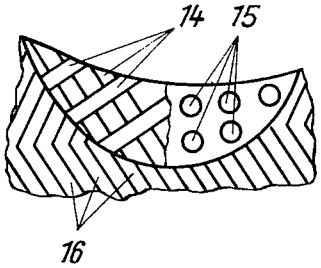
FIG. 3 shows a fragmentary view—in bottom representation—of the tread sole of such an athletic shoe with modifications in the zone of the plantar arch.

As shown by FIG. 3 in the left-hand portion of the illustration, the supporting profiles 7 may, however, also be designed as webs 14 intersecting at any desired angles. The right-hand portion of the illustration according to FIG. 3 shows supporting profiles in the form of nubs 15.

Basically, the supporting profiles 7, 12, 14, 15 can be made of the same material as the tread sole 5. In this case, the supporting profiles 7, 12, 14, 15 are preferably integrated with the remaining parts of the tread sole 5, i.e., they are, in particular, molded together with the tread sole 5 during the manufacture thereof.

However, it is also possible basically to cover the supporting profiles 7, 12, 14, 15 with a material corresponding to that of the tread sole 5, if the supporting profiles 7, 12, 14, 15 consist of another material different from that of the tread sole 5, for example due to weight reasons.

Figure 4:
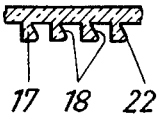
FIG. 4 shows a partial sectional view along the section line IV—IV in FIG. 2.
Figure 5:
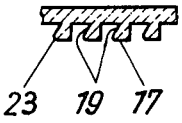
FIG. 5 shows a partial sectional view along the section line V—V in FIG. 2.

The parts of the tread sole 5 not covered by the supporting profiles 7, 12, 14, 15, i.e., the predominant zone of the front sole 10 and the predominant zone of the rear sole or heel region 11 is provided with a conventional zigzag profile 16 as indicated in FIGS. 2 and 3. This zigzag profile 16 has, in cross section, the shape of a deformed trapezoid 17 with only respectively one inclined surface 18 or 19. In this connection, attention is invited to FIGS. 4 and 5, wherein FIG. 4 is a partial section through the front sole 10 and FIG. 5 shows a partial section through the rear sole or the heel region 11. The inclined surfaces 18 and 19 are aligned in such a way that, in the region of the front sole 10, the faces of the trapezoids 17 facing away from the tip 20 of the sole are fashioned as inclined surfaces 18. In the region of the heel 11, the surfaces of the trapezoids 17 facing away from the tread sole end 21 are fashioned as inclined surfaces 19. So as not to interfere with the gliding effect of the tread sole as a whole, which effect is frequently intentional, it is advantageous to round off the free edges 22, 23 of the inclined surfaces 18, 19 in each case.

On account of the construction of the zigzag profile 16 on the tread sole side along the lines described above, it is ensured that an athletic shoe equipped with such a tread sole exhibits, on the one hand, a sufficient glidability, especially when the front sole 10 is stressed, but, on the other hand, also ensures maximum nonskid property, especially when the rearward sole part 11 is under stress. Moreover, due to the ankle support 3 according to this invention, an excellent fit is likewise ensured, which has a favorable effect on the efficiency of an athlete wearing such an athletic shoe.

The preferred field of application of this invention is particularly constituted by tennis shoes for use on sandy or synthetic resin courts with granular covering. Basically, however, the athletic shoe of this invention is likewise suited for a broad range of other uses, especially in the large area of training shoes.

The profiles 7, 12, 14 preferably have a width of 5–10 mm while profile 15 has a diameter of 5–15 mm. In all embodiments the profiles range from 3–12 mm in height. As can be seen from FIG. 1, the height of profiles 7 increases from the front and rear ends of arch 2 toward the center and the same applies for the profiles of the other embodiments, so that the profile at the center of the arch 2 has a height of 9–12 mm, the profiles at the ends of the arch 2 have a height of 3–4 mm and the intermediate profiles have a height of 7–9 mm. Additionally, the profiles 15 appear in side elevation the same as profiles 7 in FIG. 1.

Therefore, while I have shown and described several embodiments in accordance with the present invention, it is understood that the same is not limited thereto, but is susceptible to numerous changes and modifications as is known to those skilled in the art and I, therefore, do not wish to be limited to the details shown and described herein, but intend to cover all such changes and modifications as are encompassed by the scope of the appended claims.

What is claimed is:

1. Athletic shoe, especially a tennis shoe, with an insole forming an ankle support in the region of the plantar arch and with a tread sole having a tread and provided with a substantially corresponding recess in the region of the plantar arch, characterized in that several discrete supporting profiles of various heights are arranged in the region of the constriction of the tread sole, an eveloping line of which on free ends of these supporting profiles on the tread side lies at least approximately in the plane of adjoining tread sole parts.

2. Athletic shoe according to claim 1, characterized in that the supporting profiles are fashioned as ribs.

3. Athletic shoe according to claim 1 or 2, characterized in that the supporting profiles extend approximately perpendicularly to the longitudinal axis of the sole.

4. Athletic shoe according to claim 1, characterized in that the supporting profiles are fashioned as intersecting webs.

5. Athletic shoe according to claim 1, characterized in that the supporting profiles are fashioned as nubs.

6. Athletic shoe according to claims 1 or 2 or 4 or 5, characterized in that the supporting profiles consist of the same material as the tread sole.

7. Athletic shoe according to claim 3, characterized in that the supporting profiles consist of the same material as the tread sole.

8. Athletic shoe according to claim 6, characterized in that the supporting profiles are unitarily formed with the remaining parts of the tread sole.

9. Athletic shoe according to claim 1 or 2 or 4 or 5, characterized in that the free ends of the supporting profiles on the tread side are covered with a material corresponding to that of the tread sole.

10. Athletic shoe according to claim 3, characterized in that the supporting profiles are unitarily formed with the remaining parts of the tread sole.

11. Athletic shoe according to claim 1 or 2 or 4 or 5, characterized in that the parts of the tread sole not covered with the supporting profiles are equipped with a zigzag profile.

12. Athletic shoe according to claim 3, characterized in that the parts of the tread sole not covered with the supporting profiles are equipped with a zigzag profile.

13. Athletic shoe according to claim 11, characterized in that the zigzag profile has, in cross section, the shape of a deformed trapezoid with only one inclined surface.

14. Athletic shoe according to claim 13, the inclined surface faces away from the tip of the sole in a front sole region and faces toward the tip of the sole in a heel sole region.

15. Athletic shoe according to claim 14, wherein a free edge of the inclined surface is rounded.

16. Athletic shoe according to claim 13, characterized in that, in a zone of a front sole region, the inclined surface of the trapezoid faces away from the sole tip.

17. Athletic shoe according to claim 13, characterized in that, in a zone of a heel sole region, the inclined surface of the trapezoid faces away from the rear end of the sole.

18. Athletic shoe according to claim 16, characterized in that the free edges of the inclined surfaces are rounded off in each case.

* * * * *